US012421876B2

(12) United States Patent
Andrisani et al.

(10) Patent No.: US 12,421,876 B2
(45) Date of Patent: Sep. 23, 2025

(54) ROCKER WITH SWITCHABLE ROLLERS FOR ENGINE VALVETRAINS

(71) Applicant: Eaton Intelligent Power Limited, Dublin (IE)

(72) Inventors: Nicola Andrisani, Cumiana (IT); Emanuele Raimondi, Collegno (IT); Massimo D'Amore, Almese (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/934,706

(22) Filed: Nov. 1, 2024

(65) Prior Publication Data

US 2025/0059898 A1 Feb. 20, 2025

Related U.S. Application Data

(63) Continuation of application No. PCT/EP2023/025224, filed on May 11, 2023.
(Continued)

(51) Int. Cl.
*F01L 1/18* (2006.01)
*F01L 1/46* (2006.01)
(Continued)

(52) U.S. Cl.
CPC ..... *F01L 1/181* (2013.01); *F01L 1/46* (2013.01); *F01L 13/0036* (2013.01);
(Continued)

(58) Field of Classification Search
CPC ..... F01L 1/053; F01L 1/181; F01L 2001/186; F01L 1/46; F01L 2001/467; F01L 13/0036; F01L 2305/02; F01L 2820/031
(Continued)

(56) References Cited

U.S. PATENT DOCUMENTS 4,768,475 A 9/1988 Ikemura
6,302,071 B1 * 10/2001 Kobayashi ..... F01L 1/3442 123/90.38
(Continued)

FOREIGN PATENT DOCUMENTS

CN 1245245 A 2/2000
CN 105507976 A 4/2016
(Continued)

OTHER PUBLICATIONS

International search report and Written Opinion received for PCT Application No. PCT/EP2021/025464, 12 pages, Mar. 17, 2022.
(Continued)

*Primary Examiner* — Jorge L Leon, Jr.
(74) *Attorney, Agent, or Firm* — Baker Botts L.L.P.

(57) ABSTRACT

A rocker arm assembly capable of switchably deactivating a roller assembly includes a valve end and a cam end having first and second roller assemblies, and a latching mechanism. The latching mechanism includes rocker body pins and roller body pins. The rocker body pins include first and second end pins and a connection pin, each pin provided within a rocker arm body along a latching axis. The roller body pins include first and second locking pins, each roller body pin provided within a respective roller assembly. In a first latching mode, the first roller assembly is deactivated and the second roller assembly is activated. In a second latching mode, the second roller assembly is deactivated and the first roller assembly is activated.

20 Claims, 8 Drawing Sheets

Related U.S. Application Data

(60) Provisional application No. 63/340,879, filed on May 11, 2022.

(51) Int. Cl.
*F01L 13/00* (2006.01)
*F01L 1/053* (2006.01)

(52) U.S. Cl.
CPC ..... *F01L 1/053* (2013.01); *F01L 2001/186* (2013.01); *F01L 2001/467* (2013.01); *F01L 2305/02* (2020.05); *F01L 2820/031* (2013.01)

(58) Field of Classification Search
USPC ..... 123/90.44
See application file for complete search history.

(56) References Cited

U.S. PATENT DOCUMENTS

| | | | | |
|---|---|---|---|---|
| 6,318,315 | B1 | 11/2001 | Harada | |
| 6,412,460 | B1 | 7/2002 | Sato | |
| 6,604,498 | B2 | 8/2003 | Fernandez | |
| 7,827,958 | B2 | 11/2010 | Dietrich | |
| 8,056,523 | B2 * | 11/2011 | Ha | F01L 1/185 123/90.46 |
| 8,251,028 | B2 * | 8/2012 | Ezaki | F01L 1/267 74/559 |
| 2003/0010305 | A1 | 1/2003 | Genise | |
| 2005/0205019 | A1 | 9/2005 | Burk | |
| 2010/0064994 | A1 | 3/2010 | Colliou | |
| 2010/0307434 | A1 | 12/2010 | Odell | |
| 2010/0319642 | A1 | 12/2010 | Fujita | |
| 2011/0303168 | A1 | 12/2011 | Ting | |
| 2014/0137823 | A1 | 5/2014 | Sugiura | |
| 2014/0251266 | A1 | 9/2014 | Emmons | |
| 2017/0009610 | A1 | 1/2017 | Ahmed | |
| 2019/0055861 | A1 | 2/2019 | Persson | |
| 2024/0011419 | A1 | 1/2024 | Raimondi | |
| 2024/0141808 | A1 | 5/2024 | Raimondi | |

FOREIGN PATENT DOCUMENTS

| | | | | | |
|---|---|---|---|---|---|
| CN | 107795352 | A | * | 3/2018 | F01L 1/053 |
| CN | 111997704 | A | | 11/2020 | |
| CN | 112513430 | A | | 3/2021 | |
| CN | 112585337 | A | | 3/2021 | |
| DE | 102009041368 | A1 | | 3/2011 | |
| DE | 102011085708 | A1 | | 5/2013 | |
| DE | 102011085709 | A1 | | 5/2013 | |
| DE | 102018114572 | A1 | | 12/2018 | |
| EP | 0607918 | B1 | | 1/1996 | |
| EP | 0826867 | A1 | | 3/1998 | |
| EP | 0978637 | A2 | | 2/2000 | |
| EP | 1143120 | A2 | | 10/2001 | |
| EP | 2427642 | B1 | | 1/2014 | |
| EP | 2625395 | B1 | | 7/2015 | |
| EP | 3170997 | A1 | | 5/2017 | |
| GB | 2333322 | A | | 7/1999 | |
| JP | H 10-073009 | A | | 3/1998 | |
| JP | 2000045737 | A | | 2/2000 | |
| JP | 2001329817 | A | | 11/2001 | |
| JP | 2009047111 | A | | 3/2009 | |
| JP | 2009197732 | A | | 9/2009 | |
| JP | 6305768 | B2 | | 4/2018 | |
| WO | WO 2010100753 | A1 | | 9/2010 | |
| WO | WO 2011125194 | A1 | | 10/2011 | |
| WO | WO 2023143874 | A1 | | 8/2023 | |

OTHER PUBLICATIONS

International search report and Written Opinion received for PCT Application No. PCT/EP2022/025100, 17 pages, Jun. 30, 2022.
International search report and Written Opinion received for PCT Application No. PCT/EP2023/025043, 12 pages, May 23, 2023.
International search report and Written Opinion received for PCT Application No. PCT/EP2023/025224, 11 pages, Sep. 8, 2023.

* cited by examiner

3

ROCKER WITH SWITCHABLE ROLLERS FOR ENGINE VALVETRAINS

PRIORITY

This application is a continuation under 35 U.S.C. § 365 (c) of International Patent Application No. PCT/EP2023/025224, filed on 11 May 2023, which claims the benefit under 35 U.S.C. § 119 (c) of U.S. Provisional Patent Application No. 63/340,879, filed 11 May 2022, all of which are incorporated herein by reference.

TECHNICAL FIELD

This application relates to rocker arm assemblies and, more particularly, to variable valve lift rocker arm assemblies with switchable roller systems for use in, for example, valvetrains of internal combustion engines, allowing the use of variable valve actuation techniques.

BACKGROUND

Internal combustion engines may include valvetrains, wherein, in particular configurations, engine valvetrains may include rocker arms for controlling the opening and closing of intake and/or exhaust valves. Variable valve actuation mechanisms, such as cylinder deactivation and variable valve lift, exist that can improve engine performance, fuel economy, and/or emissions of internal combustion engines. In particular configurations of engine valvetrain, switchable rocker arms may be employed to support variable valve actuation.

The description provided herein is for the purpose of generally presenting the context of the disclosure. Work of the presently named inventors, to the extent it is described in this section, as well as aspects of the description that cannot otherwise qualify as prior art at the time of filing, are neither expressly nor impliedly admitted as prior art against the present disclosure.

SUMMARY OF PARTICULAR EMBODIMENTS

In particular embodiments, a rocker arm assembly is disclosed for switchably deactivating a roller assembly, the rocker arm assembly comprising a valve end and a cam end opposite the valve end, the cam end comprising a rocker arm body; further, a first roller assembly comprises a first roller and a second roller assembly comprises a second roller, each roller assembly being pivotably connected to the rocker arm body, each roller being configured to rotate about a respective roller axis and engage with a respective cam; and a latching mechanism configured to selectively decouple one of the first roller assembly or the second roller assembly from the rocker arm body, the latching mechanism comprising rocker body pins comprising a first end pin, a second end pin, and a connection pin disposed between the first and second end pins, each of the rocker body pins slidably disposed at least partially within the rocker arm body along a latching axis; and roller body pins comprising a first locking pin and a second locking pin, the first locking pin disposed between the first end pin and the connection pin, the second locking pin disposed between the connection pin and the second end pin, each of the roller body pins slidably disposed at least partially within a respective roller assembly along a respective roller axis, wherein, when a first latching mode is enabled, the first roller assembly is deactivated and the second roller assembly is activated based on selectively and slidably displacing the rocker body pins and the roller body pins toward the second end pin, and wherein, when a second latching mode is enabled, the second roller assembly is deactivated and the first roller assembly is activated based on selectively and slidably displacing the rocker body pins and the roller body pins toward the first end pin.

In particular embodiments, which may combine the features of some or all of the above embodiments, when the first latching mode is enabled, the first end pin is axially extended toward the first roller assembly such that the first locking pin is axially contained within the first roller assembly and the connection pin is at least partially disposed within the roller axis of the second roller assembly, enabling the first roller assembly to pivotally absorb a first cam motion, thereby deactivating the first roller assembly, and enabling the second roller assembly to be operatively coupled to the rocker arm body to transmit a second cam motion to the rocker arm body, thereby activating the second roller assembly.

In particular embodiments, which may combine the features of some or all of the above embodiments, when the second latching mode is enabled, the second end pin is axially extended toward the second roller assembly such that the second locking pin is axially contained within the second roller assembly and the connection pin is at least partially disposed within the roller axis of the first roller assembly, enabling the second roller assembly to pivotally absorb a second cam motion, thereby deactivating the second roller assembly, and enabling the first roller assembly to be operatively coupled to the rocker arm body to transmit a first cam motion to the rocker arm body, thereby activating the first roller assembly.

In particular embodiments, which may combine the features of some or all of the above embodiments, the first and second roller assemblies respectively comprise, and are respectively biased by, first and second roller biasing members, each roller assembly biased by the respective biasing member toward a respective end position wherein the respective roller body pin corresponding to each roller assembly is coaxially located with the latching axis of the rocker body pins. In particular embodiments, which may combine the features of some or all of the above embodiments, the first roller biasing member is the same as the second roller biasing member. In particular embodiments, which may combine the features of some or all of the above embodiments, the connection pin has a length measured along the latching axis that is greater than a shortest distance between the first and second roller assemblies measured along the latching axis. In particular embodiments, which may combine the features of some or all of the above embodiments, each roller body pin has a length measured along the respective roller axis that enables the respective roller body pin to be selectively axially contained within the respective roller assembly. In particular embodiments, which may combine the features of some or all of the above embodiments, one of the first end pin or the second end pin is biased toward the other of the first end pin or the second end pin by a pin biasing member. In particular embodiments, which may combine the features of some or all of the above embodiments, the rocker arm is configured to selectively rotate about a rocker shaft located between the valve end and the cam end. In particular embodiments, which may combine the features of some or all of the above embodiments, one or both of the first end pin and the second end pin are selectively extendable based on a force applied by an actuator system. In particular embodiments, which may combine the features of some or all of the above embodiments, the actuator system comprises a hydraulic actuator. In particular embodiments, which may combine the features of some or all of the above embodiments, wherein the actuator system comprises a solenoid.

In particular embodiments, which may combine the features of some or all of the above embodiments, a method of selectively decoupling one of a first roller assembly or a second roller assembly from a rocker arm body is disclosed, the method comprising, in a first latching mode, axially translating a first end pin toward the first roller assembly, a latching mechanism comprising the first end pin, a second end pin, and a connection pin disposed between the first and second end pins, each of the first end, second end, and connection pins slidably disposed at least partially within the rocker arm body along a latching axis, the axial translation of the first end pin associated with a first locking pin being axially contained within the first roller assembly and the connection pin being at least partially disposed within a roller axis of the second roller assembly, the latching mechanism further comprising the first locking pin and a second locking pin, the first locking pin disposed between the first end pin and the connection pin, the second locking pin disposed between the connection pin and the second end pin; deactivating, based on the first locking pin being axially contained within the first roller assembly, the first roller assembly by enabling the first roller assembly to pivotally absorb a first cam motion; and activating, based on the connection pin being at least partially disposed within the roller axis of the second roller assembly, the second roller assembly by enabling the second roller assembly to be operatively coupled to the rocker arm body to transmit a second cam motion to the rocker arm body.

In particular embodiments, which may combine the features of some or all of the above embodiments, the method of selectively decoupling a first roller assembly or a second roller assembly from a rocker arm body comprises, in a second latching mode, axially translating the second end pin toward the second roller assembly, the axial translation of the second end pin associated with the second locking pin being axially contained within the second roller assembly and the connection pin being at least partially disposed within a roller axis of the first roller assembly; deactivating, based on the second locking pin being axially contained within the second roller assembly, the second roller assembly by enabling the second roller assembly to pivotally absorb a second cam motion; and activating, based on the connection pin being at least partially disposed within the roller axis of the first roller assembly, the first roller assembly by enabling the first roller assembly to be operatively coupled to the rocker arm body to transmit a first cam motion to the rocker arm body.

In particular embodiments, which may combine the features of some or all of the above embodiments, the method of selectively decoupling a first roller assembly or a second roller assembly from a rocker arm body comprises biasing the first roller assembly by a first roller biasing member and the second roller assembly by a second roller biasing member, each roller assembly biased by the respective biasing member toward a respective end position wherein the first locking pin and the second locking pin are respectively coaxially located with the latching axis. In particular embodiments, which may combine the features of some or all of the above embodiments, the first roller biasing member is the same as the second roller biasing member. In particular embodiments, which may combine the features of some or all of the above embodiments, the method of selectively decoupling a first roller assembly or a second roller assembly from a rocker arm body comprises biasing one of the first end pin or the second end pin toward the other of the first end pin or the second end pin by a pin biasing member.

In particular embodiments, which may combine the features of some or all of the above embodiments, an engine valvetrain system is disclosed including a camshaft comprising a plurality of cams; a plurality of valves; a rocker arm assembly configured to rotate about a rocker shaft, the rocker arm assembly comprising a valve end configured to selectively engage with two or more valves of the plurality of valves, and a cam end opposite the valve end, the cam end comprising: a rocker arm body; a first roller assembly comprising a first roller and a second roller assembly comprising a second roller, each roller assembly pivotally connected to the rocker arm body, each roller configured to rotate about a respective roller axis and engage with a respective cam of the plurality of cams; and a latching mechanism configured to selectively decouple one of the first roller assembly or the second roller assembly from the rocker arm body, the latching mechanism comprising rocker body pins comprising a first end pin, a second end pin, and a connection pin disposed between the first and second end pins, each of the rocker body pins slidably disposed at least partially within the rocker arm body along a latching axis; and roller body pins comprising a first locking pin and a second locking pin, the first locking pin disposed between the first end pin and the connection pin, the second locking pin disposed between the connection pin and the second end pin, each of the roller body pins slidably disposed at least partially within a respective roller assembly along a respective roller axis, wherein, when a first latching mode is enabled, the first roller assembly is deactivated and the second roller assembly is activated based on selectively and slidably displacing the rocker body pins and the roller body pins toward the second end pin, and wherein, when a second latching mode is enabled, the second roller assembly is deactivated and the first roller assembly is activated based on selectively and slidably displacing the rocker body pins and the roller body pins toward the first end pin.

In particular embodiments, which may combine the features of some or all of the above embodiments, the first and second roller assemblies further comprise, and are respectively biased by, first and second roller biasing members, each roller assembly biased by the respective biasing member toward a respective end position wherein the respective roller body pin corresponding to each roller assembly is coaxially located with the latching axis of the rocker body pins. In particular embodiments, which may combine the features of some or all of the above embodiments, the first roller biasing member is the same as the second roller biasing member.

BRIEF DESCRIPTION OF THE DRAWINGS

The present invention will be described in greater detail below based on the exemplary figures. The invention is not limited to the exemplary embodiments. Other features and advantages of various embodiments of the present invention will become apparent by reading the following detailed description with reference to the attached drawings which illustrate the following.

Figure 1:
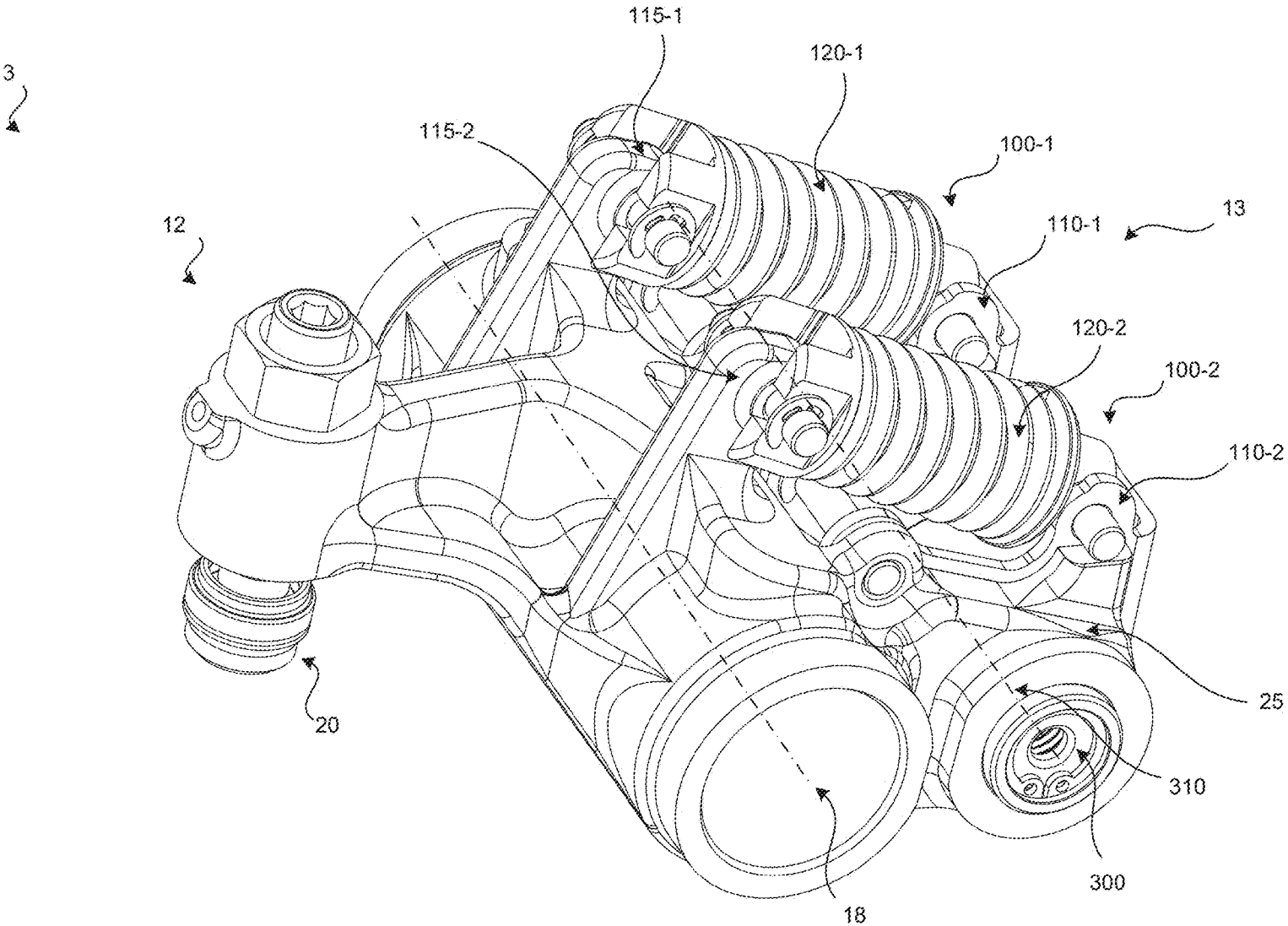
FIG. 1 illustrates a schematic perspective view of a rocker arm assembly, according to particular embodiments.

It should be noted that figures provided may be illustrated schematically rather than literally or precisely; components and aspects of the figures may also not necessarily be to scale. Moreover, while like reference numerals may designate corresponding parts throughout the different views in many cases, like parts may not always be provided with like reference numerals in each view.

DESCRIPTION OF EXAMPLE EMBODIMENTS

In accordance with various embodiments of the present disclosure, various mechanisms, assemblies, arrangements, and methods of operation, manufacture, and/or assembly of engine valvetrains, rocker arm assemblies, and/or related subsystems are disclosed herein. For clarity, not all features of each actual implementation or embodiment may be described in this specification. Additionally, some aspects and features may be described at a high level.

Further, features and aspects that are disclosed, illustrated, and/or apparently otherwise contemplated in certain specific configurations are fully contemplated to be mixed or combined to produce any and all resulting configurations using features and aspects from any embodiments and/or configurations considered herein. Features, limitations, and/or other descriptions that may follow or be introduced with respective to particular figures may separately or additionally apply and be contemplated with respect to other embodiments, and/or descriptions relating to other figures, whether individually or in combination. Thus, modifications, variations, adaptations, and/or combinations of features and aspects may be made that result in embodiments that are fully contemplated to fall within the scope of this disclosure.

In particular embodiments, engine valvetrains may include rocker arms for controlling the opening and closing of intake and/or exhaust valves of an engine. In particular embodiments, a rocker arm may comprise a selectively rotating or reciprocating body that may translate rotational motion of a cam lobe of a rotating camshaft lobe into motion that can control the opening and closing of a valve. In particular embodiments, a rocker arm may be configured to rotate about a rocker shaft, with a cam end of the rocker arm provided in direct or indirect contact with one or more rotating cams, and a valve end situated at an opposite end to the cam end directly or indirectly (e.g., via a valve bridge) interfacing with one or more valves of the engine.

Variable valve actuation mechanisms, such as cylinder deactivation and variable valve lift, have been introduced to improve engine performance, fuel economy, and/or emissions of an internal combustion engine. One or more switchable rocker arms may be used in particular embodiments to support variable valve actuation.

Figure 2:
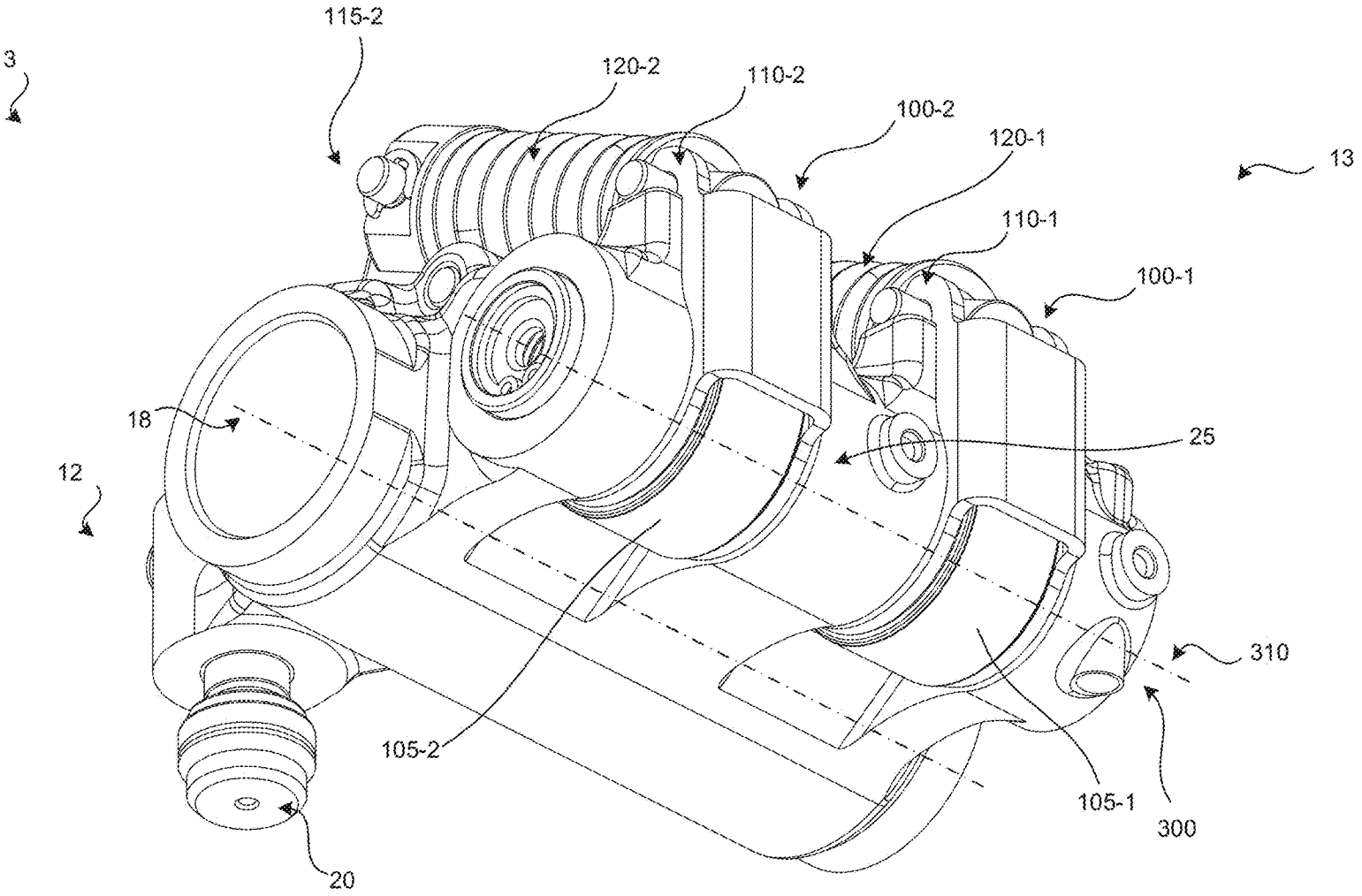
FIG. 2 illustrates a schematic perspective view of a rocker arm assembly, according to particular embodiments.

With reference to the figures, FIG. 1 and FIG. 2 illustrate schematic perspective views of a rocker arm assembly, according to particular embodiments.

In particular embodiments, rocker arm assembly 3 may configured to selectively pivot or rotate on a rocker shaft (not shown) about a rocker shaft axis 18, and may comprise a valve end 12 and a cam end 13. In particular embodiments, rocker arm assembly 3 may have a center-pivot configuration, with cam end 13 located opposite to valve end 12, and with rocker shaft axis 18 provided between valve end 12 and cam end 13, such as in a Type III valvetrain system as a non-limiting example. In particular embodiments, rocker arm assembly 3 may have an end-pivot configuration.

In particular embodiments, valve end 12 may comprise structures, mechanisms, and/or assemblies for interfacing with one or more valves of the engine. As non-limiting examples, valve end 12 may comprise one or more feet and/or extended structures, such as E-foot 20, as well as one or more optional capsules, mechanisms, adjustment mechanisms (such lash adjustment mechanisms), some of which may be switchable, and/or automatically adjustable. In particular embodiments, parts of valve end 12 may directly interface with one or more valves of the engine. In particular embodiments, parts of valve end 12 of rocker arm assembly may indirectly interface with one or more valves. By way of example and not limitation, parts of valve end may interface with one or more engine valves via a valve bridge, and/or through a valve bridge using a pin or socket, or other suitable structure.

In particular embodiments, cam end 13 may comprise an outer rocker arm cam end body 25 (also referred to herein as rocker arm body 25), and one or more roller assemblies 100. As a non-limiting example, cam end 13 may comprise a switchable pair of roller assemblies 100-1 and 100-2. Each roller assembly 100-1 and 100-2 may comprise a corresponding roller (105-1 and 105-2, respectively), wherein each roller may rotate about a corresponding roller axis (130-1 and 130-2, respectively) on a corresponding roller axle (125-1 and 125-2, respectively; illustrated in FIGS. 3A-3D, 4, and 5). Each roller 105-1 and 105-2 may be configured to operatively engage with a cam or cam lobe of a respective camshaft, and receive a cam lift profile from the respective cam as the camshaft rotates.

In particular embodiments, one or more roller assemblies 100 (such as 100-1 and/or 100-2) are movable relative to rocker arm body 25. In particular embodiments, roller assemblies 100 may be operatively connected to rocker arm body 25 by way of one or more roller assembly support structures 110 such that roller assemblies 100 may be movable with respect to rocker arm body 25. By way of example and not limitation, roller assemblies 100-1 and 100-2 may be pivotably connected to rocker arm 25 via roller assembly support structures 110-1 and 110-2, respectively, further using pivot connections 115-1 and 115-2, respectively, at the rocker arm body 25. In particular embodiments, a number of roller assembly support structures 110 and/or pivot connections 115 may not equal the number of rocker arm assemblies 100. In particular embodiments, one or more connections and/or support structures for movably supporting one or more roller assemblies 100 may be based on pivots, hinges, ball joints, ball-and-socket joints, universal joints, and/or any other suitable type of connection, joint, or structure, or any suitable combination thereof.

In particular embodiments, one or more roller assembly biasing members 120 may be provided to bias one or more roller assemblies 100. In particular embodiments, as illustrated in FIGS. 1, 2, 4, and 5 by way of non-limiting examples, each roller assembly 100-1 and 100-2 may be provided with a respective roller assembly biasing member 120-1 and 120-2. In particular embodiments, as illustrated in FIGS. 3A-3D by way of non-limiting examples, multiple roller assemblies 100 (such as a pair of roller assemblies 100-1 and 100-2 of FIGS. 3A-3D) may be provided with a different number or count of roller assembly biasing members 120 (such as the single roller assembly biasing member 120 illustrated in FIGS. 3A-3D). In particular embodiments, a roller assembly biasing member 120 may comprise a spring.

In particular embodiments, one or more roller assemblies 100 (such as 100-1 and 100-2) may be selectively and/or switchably rendered fixed or movable with respect to rocker arm body 25. By way of example and not limitation, one or more roller assemblies 100 (such as 100-1 and/or 100-2) may be selectively or switchably activated or enabled by locking or coupling with respect to rocker arm body 25, such that a cam lift profile or cam motion received by a locked roller assembly 100 may be transmitted to the rocker arm body 25. By way of example and not limitation, one or more roller assemblies 100 (such as 100-1 and/or 100-2) may be selectively or switchably deactivated or disabled by unlocking or movably decoupling the respective roller assembly with respect to rocker arm body 25, such that a cam lift profile or cam motion received by an unlocked roller assembly 100 may be absorbed by lost motion due to at least one roller assembly biasing member 120, and thereby causing the cam lift profile or cam motion to not be transmitted to the rocker arm body 25.

FIGS. 1 and 2 illustrate a non-limiting example of a rocker assembly 3 having two roller assemblies (100-1 and 100-2), each roller assembly illustrated therein in a neutral or fully extended position corresponding to a base circle or minimum lift cam position.

Figure 3A:
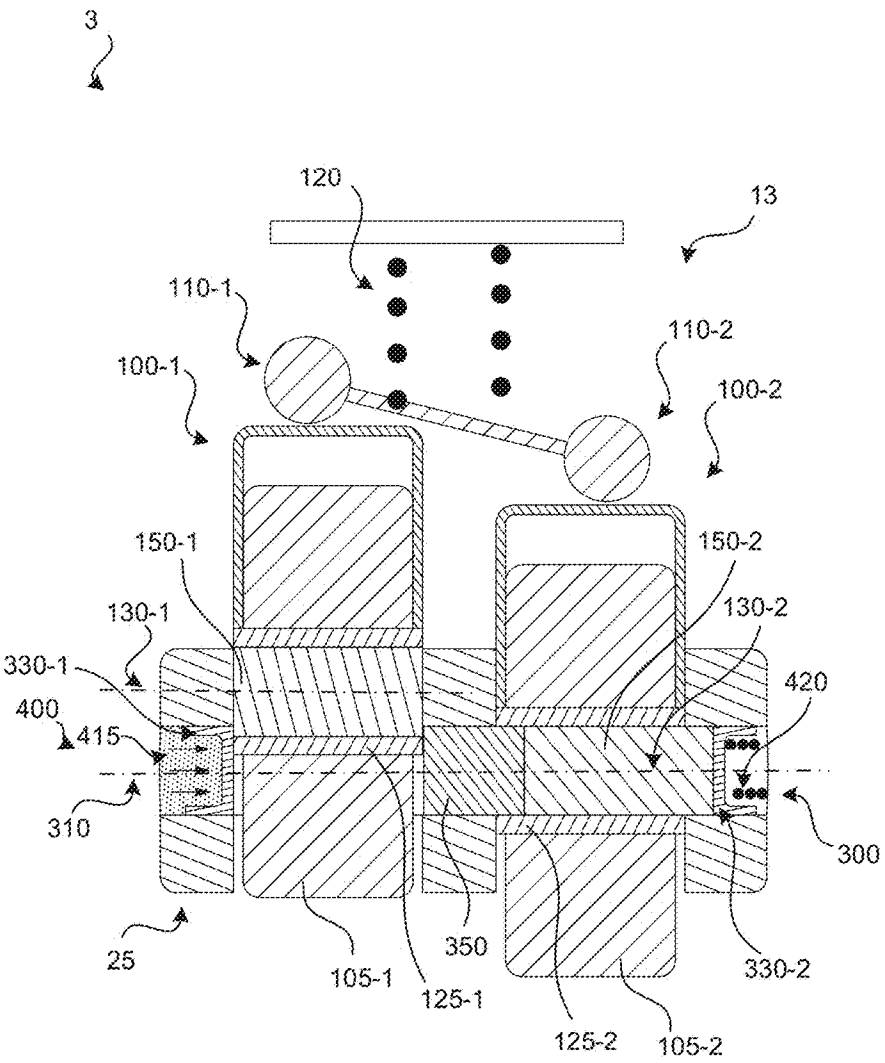
FIGS. 3A-3B respectively illustrate schematic sectional views of a rocker arm assembly in a first latching mode and a second latching mode, according to particular embodiments.
Figure 3B:
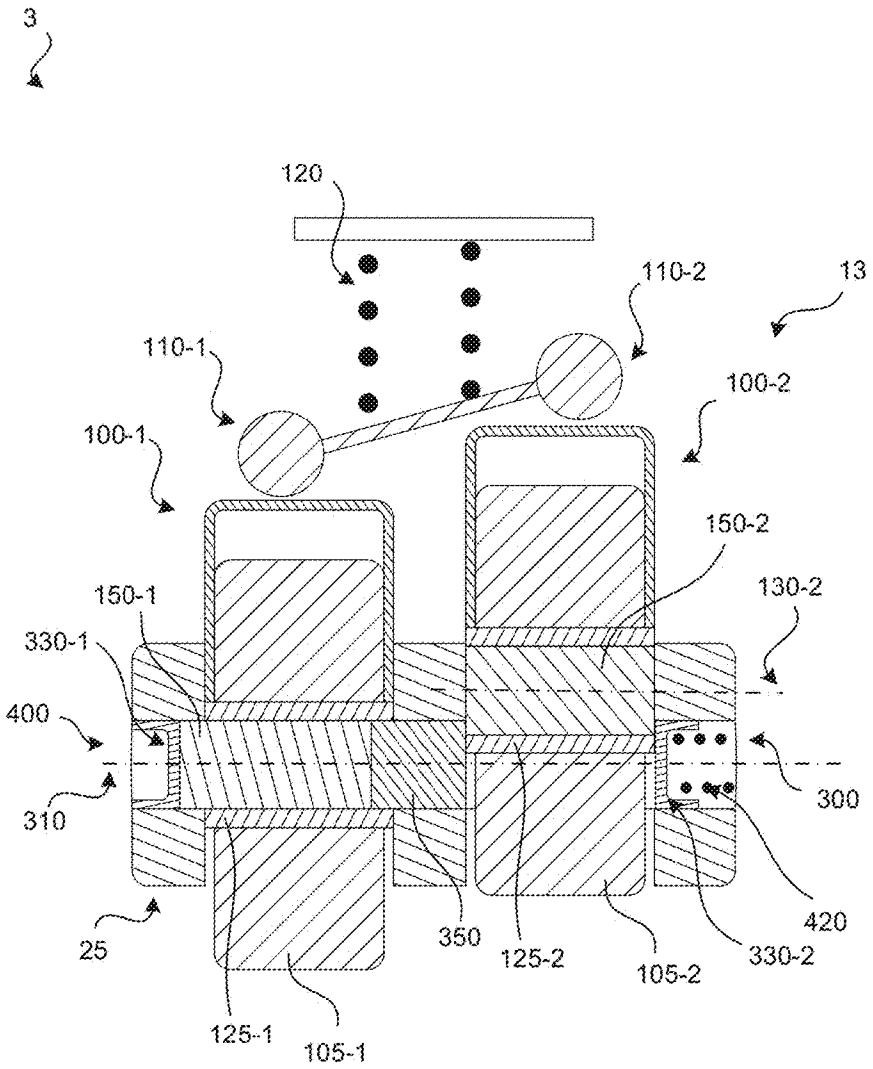
Figure 3C:
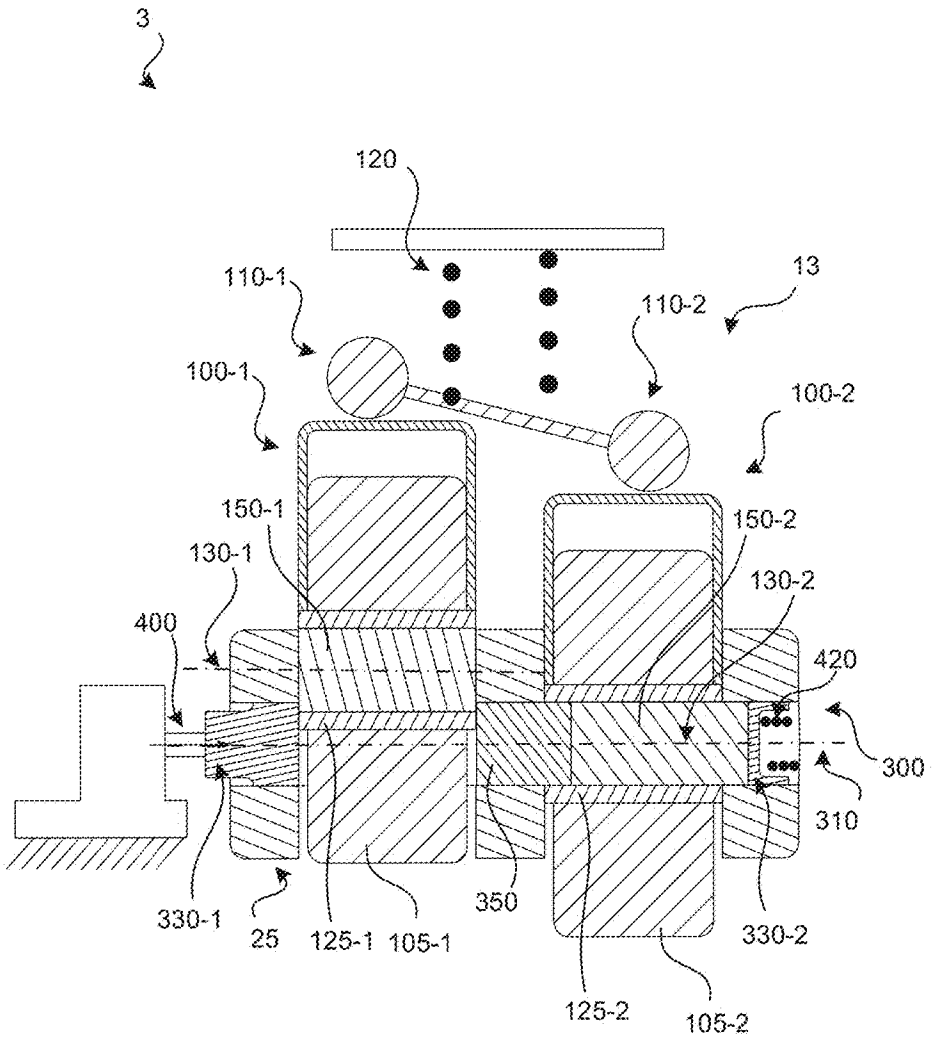
FIGS. 3C-3D respectively illustrate schematic sectional views of a rocker arm assembly in a first latching mode and a second latching mode, according to particular embodiments.
Figure 3D:
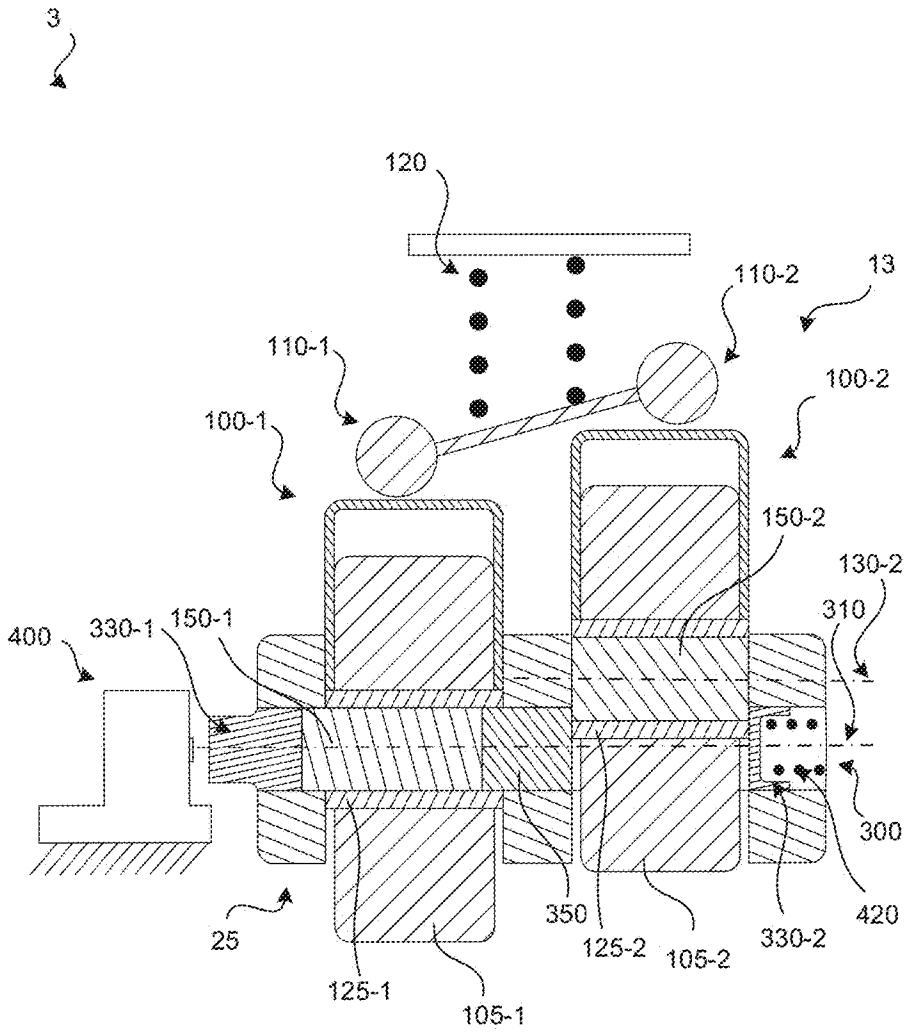

FIGS. 3A-3B respectively illustrate schematic sectional views of a rocker arm assembly in a first latching mode and a second latching mode, according to particular embodiments. FIGS. 3C-3D respectively illustrate schematic sectional views of a rocker arm assembly in a first latching mode and a second latching mode, according to particular embodiments.

In particular embodiments, rocker arm assembly 3 may be provided with a switchable latching assembly 300 for selectively or switchably deactivating one or more roller assemblies 100. By way of example and not limitation, a latching assembly 300 may be provided that can selectively decouple roller assembly 100-1 and/or 100-2. In particular embodiments, a latching assembly 300 may be provided that is configured to, based on design and when a subset of roller assemblies 100 have been activated, to automatically deactivate or disable one or more of the remaining roller assemblies 100 of rocker arm assembly 3. In particular embodiments, a latching assembly 300 may be provided that is configured to, based on design and when a subset of roller assemblies 100 have been deactivated or disabled, to automatically activate or enable one or more of the remaining roller assemblies 100 of rocker arm assembly 3.

Figure 4:
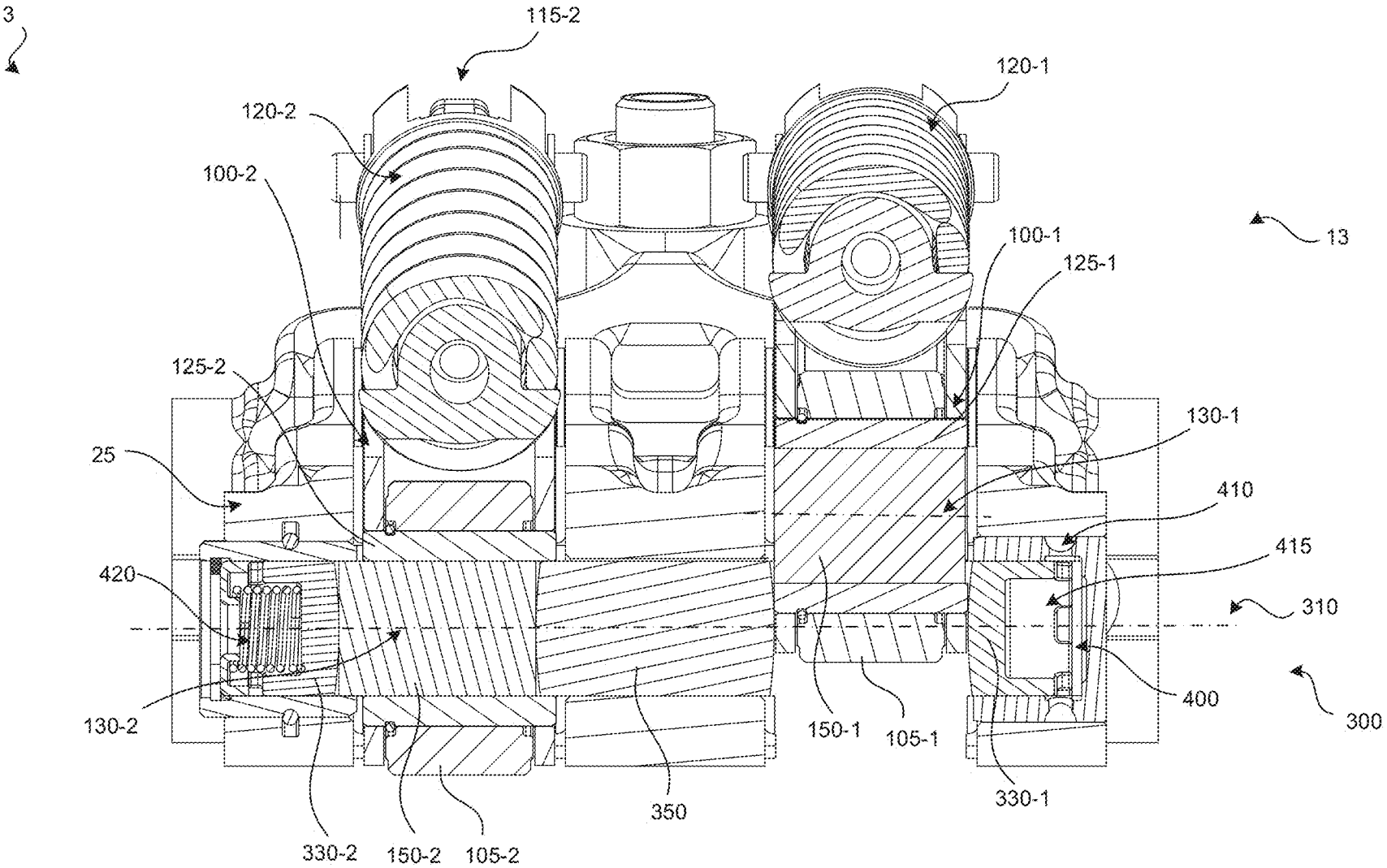
FIG. 4 illustrates a schematic sectional view of a rocker arm assembly in a first latching mode, according to particular embodiments.
Figure 5:
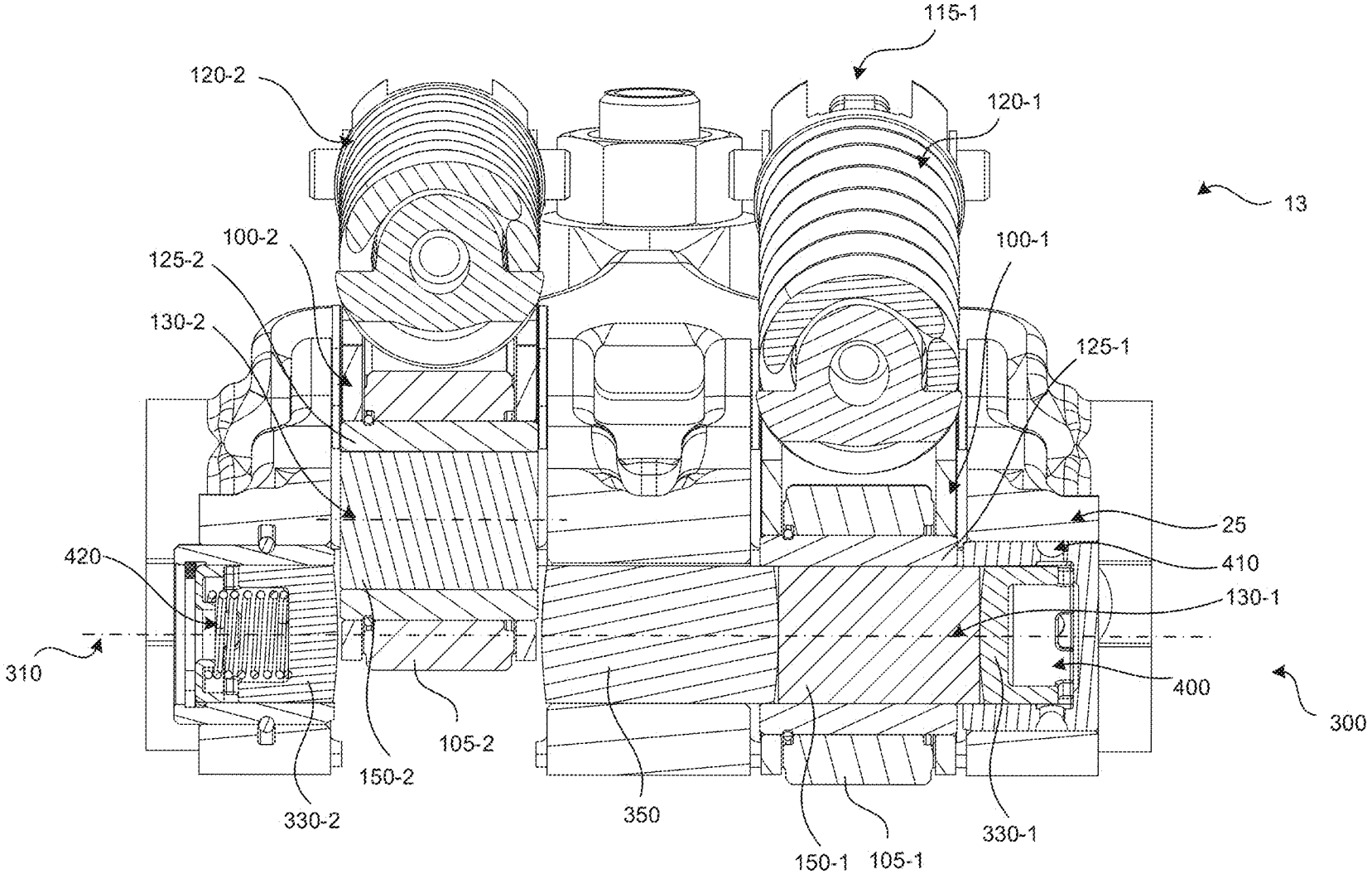
FIG. 5 illustrates a schematic sectional view of a rocker arm assembly in a second latching mode, according to particular embodiments.

FIG. 4 illustrates a schematic sectional view of a rocker arm assembly in a first latching mode, according to particular embodiments. FIG. 5 illustrates a schematic sectional view of a rocker arm assembly in a second latching mode, according to particular embodiments.

By way of illustration and not by way of limitation, following an example of a rocker arm assembly 3 having two switchable roller assemblies 100, latching assembly 300 may be configured in particular embodiments to be switched between a first latching mode and a second latching mode, wherein: (1) if a one (such as a first) of the two roller assemblies is enabled in a first latching mode, another (such as the second) of the two roller assemblies may be automatically deactivated in that first latching mode, and (2) in a corresponding second latching mode, another (such as the second) of the two roller assemblies is deactivated, and the one (such as the first) of the two roller assemblies is enabled. Such an example may be usefully considered to be illustrated by any suitable figure(s) provided herein, without limiting the scope of any other embodiments contemplated herein based on other features that may be illustrated in said figure(s).

By way of example and not limitation, FIGS. 3A, 3C, and 4 illustrate examples of rocker arm assemblies in a first latching mode wherein, based on operation of latching assembly 300 (to be further detailed herein), a roller assembly 100-2 may be enabled by locking or operatively coupling roller assembly 100-2 with respect to rocker arm body 25, such that a corresponding cam motion or cam lift profile received by roller 105-2 can be transmitted and accordingly cause motion of rocker arm 25 about rocker shaft axis 18, such that rocker arm assembly 3 may correspondingly act on one or more valves via valve end 12 following the cam lift profile received by roller assembly 100-2. As also illustrated in FIGS. 3A, 3C, and 4, when roller assembly 100-2 is enabled, another roller assembly of the roller assembly set, such as roller assembly 100-1 in these non-limiting examples, can be automatically decoupled by the latching assembly 300 by enabling pivotal motion of roller assembly 100-1 relative to rocker arm body 25, such that a corresponding cam motion or cam lift profile received by roller 105-1 can be absorbed (by at least one roller assembly biasing member, such as common roller assembly biasing member 120 in FIGS. 3A and 3C, or such as dedicated roller assembly biasing member 120-1 in FIG. 4, in these non-limiting examples), thereby automatically deactivating roller assembly 100-1.

Continuing with reference to the non-limiting example described above, FIGS. 3B, 3D, and 5 illustrate examples of rocker arm assemblies in a second latching mode (relative to a first latching mode illustrated in FIGS. 3A, 3C, and 4, respectively) wherein, based on an operational mode switch based on latching assembly 300 (to be further detailed herein), roller assembly 100-1 may be enabled by locking or operatively coupling roller assembly 100-1 with respect to rocker arm body 25, such that a corresponding cam motion or cam lift profile received by roller 105-1 can be transmitted and accordingly cause motion of rocker arm 25 about rocker shaft axis 18, such that rocker arm assembly 3 may correspondingly act on one or more valves via valve end 12 following the cam lift profile received by roller assembly 100-1. As also illustrated in FIGS. 3B, 3D, and 5, when roller assembly 100-1 is enabled, another roller assembly of the roller assembly set, such as roller assembly 100-2 in these non-limiting examples, can be automatically decoupled by latching assembly 300 by enabling pivotal motion of roller assembly 100-2 relative to rocker arm body 25, such that a corresponding cam motion or cam lift profile received by roller 105-2 can be absorbed (by at least one roller assembly biasing member, such as common roller assembly biasing member 120 in FIGS. 3B and 3D, or such as dedicated roller assembly biasing member 120-2 in FIG. 5) in these non-limiting examples), thereby automatically deactivating roller assembly 100-2.

By way of example and not limitation, FIG. 4 illustrates roller assembly 100-1 unlocked or decoupled from rocker arm body 25, and occupying an offset position based on receiving and absorbing a cam motion or lift from roller 105-1 such that roller axis 130-1 is not aligned with a latching axis 310 (further described herein), and also illustrating roller assembly 100-2 locked or operatively coupled with respect to rocker arm body 25 so that roller axis 130-2 is aligned with latching axis 310 in this example. By way of example and not limitation, FIG. 5 illustrates roller assembly 100-2 unlocked or decoupled from rocker arm body 25, and occupying an offset position based on receiving and absorbing a cam motion from roller 105-2 such that roller axis 130-2 is not aligned with latching axis 310, and also illustrating roller assembly 100-1 locked or operatively coupled with respect to rocker arm body 25 so that roller axis 130-1 is aligned with latching axis 310 in this example.

In particular embodiments, latching assembly 300 may comprise a set of rocker body pins. In particular embodiments, the set of rocker body pins may comprise one or more end pins 330, such as end pins 330-1 and 330-2, provided within rocker arm body 25 along a latching axis 310. In particular embodiments, the set of rocker body pins may comprise one or more connection pins, such as connection pin 350, provided within rocker arm body 25 along latching axis 310 and axially located between particular end pins, such as end pins 330-1 and 330-2. In particular embodiments, end pins, such as end pins 330-1 and 330-2, may be axially movable between a recessed (or retracted) position and an extended position. In particular embodiments, one or more end faces of one or more rocker body pins may be provided with suitable features to facilitate smooth contact with any adjacent pin(s) that may experience relative motion or incipient relative motion along one or more degrees of freedom. By way of example and not limitation, one or more faces of rocker body pins may be provided with a convex shape or other suitable shape about the latching axis, such that smooth contact may be achieved with respect to an adjacent pin, such as an adjacent roller body pin (further detailed herein).

In particular embodiments, one or more end pins may be configured to be selectively or switchably extended based on one or more actuators and/or force or displacement sources. By way of example and not limitation, end pins 330-1 of FIGS. 3A-3D, 4, and 5 are illustrated to be selectively or switchably extendable based on actuator 400. By way of example and not limitation, actuator 400 may comprise one or more hydraulic actuators, electrically energized solenoids, linear actuators, electromechanical or mechanical actuators, other force or displacement sources, or any suitable actuator mechanism or combination thereof. As a non-limiting example, FIGS. 3A and 3B, and FIGS. 4 and 5 illustrate a hydraulic actuator 400 selectively acting on end pin 330-1. As a non-limiting example, as illustrated in FIGS. 4 and 5, a hydraulic bore 410 may fluidly communicate selectively pressurized hydraulic or control fluid, such as oil, to exert or relax an extending force on chamber 415 of end pin 330-1. As a non-limiting example, FIGS. 3C and 3D illustrate actuator 400 comprising a mechanical force source selectively acting on end pin 330-1. It should be appreciated that while particular figures or disclosure aspects may be particularly illustrated with particular forms of actuation as non-limiting examples, and/or may provide particular details, any suitable form of actuation is fully contemplated for each or any figure and/or aspect of disclosure, individually as well as in combination with other aspects disclosed therein.

In particular embodiments, one end pin of a set of end pins may be biased by a pin biasing member toward another end pin. By way of example and not limitation, end pins 330-2 of FIGS. 3A-3D, 4, and 5 are illustrated to be biased toward end pin 330-1 by pin biasing member 420. In particular embodiments, pin biasing member 420 may comprise a spring.

It should be further appreciated that while particular figures or disclosure aspects may be particularly illustrated as having particular configurations and/or combinations of actuation and/or biasing members as non-limiting examples, any suitable configuration and/or combination of actuation and/or biasing members is fully contemplated for each figure and/or aspect of disclosure, individually as well as in combination with other aspects disclosed therein. For example without limitation, for a switchable rocker arm assembly 3 having two end pins 330-1 and 330-2, configurations are contemplated wherein: (1) both end pins 330-1 and 330-2 are provided with actuators 400-1 and 400-2, respectively (not shown), and neither end pin of end pins 330-1 and 330-2 is provided with a pin biasing member 420; (2) both end pins 330-1 and 330-2 are provided with actuators 400-1 and 400-2, respectively, and one or both end pins 330-1 and 330-2 are additionally provided with one or more pin biasing members 420; (3) one of the end pins 330-1 and 330-2 is provided with an actuator 400, and the other end pin of end pins 330-1 and 330-2 is provided with a pin biasing member 420. As mentioned, any of the above configurations, and/or any other, is fully contemplated in combination with any other features, aspects, or configurations disclosed or illustrated herein.

In particular embodiments, a connection pin, such as connection pin 350, may have a length measured along the latching axis 310 that is greater than a shortest distance measured along the latching axis between the roller assemblies adjacent to the connection pin, such as roller assemblies 100-1 and 100-2 in the non-limiting examples of FIGS. 3A-3D, 4, and 5.

In particular embodiments, latching assembly 300 may comprise a set of one or more roller body pins, wherein each roller body pin may be at least partially provided within a respective roller assembly 100. In particular embodiments, each roller body pin may be slidably disposed within the respective roller assembly 100, such as within a respective roller axle 125 and/or along a respective roller axis 130. In particular embodiments, each roller body pin may have a length measured along the respective roller axis 130 that may enable the respective roller body pin to be axially contained within the respective roller assembly 100 when operationally desired. In particular embodiments, one or more end faces of one or more roller body pins may be provided with suitable features to facilitate smooth contact with adjacent pins that may experience relative motion along one or more degrees of freedom. By way of example and not limitation, one or more faces of roller body pins may be provided with a convex or other suitable shape about a respective roller axis, such that smooth contact may be achieved with respect to an adjacent pin, such as an adjacent rocker body pin.

By way of example and not limitation, as illustrated in FIGS. 3A-3D, 4, and 5, a set of roller body pins may comprise locking pins 150-1 and 150-2 provided within roller assemblies 100-1 and 100-2 respectively, locking pins 150-1 and 150-2 slidably disposed within respective roller axles 125-1 and 125-2. As further illustrated in FIGS. 3A-3D, 4, and 5 by way of non-limiting example, each locking pin 150 can be provided a length along the respective roller axis 130 such that if appropriately axially positioned (such as by selective axial sliding), each locking pin 150 may be axially contained within the respective roller assembly 100, and/or positioned to not interfere with a pivoting or other motion of a respective roller assembly 100 relative to rocker arm body 25, such as if that roller assembly 100 were decoupled from rocker arm body 25.

By way of example and not limitation, with reference to FIGS. 3A, 3C, and 4, in a first latching mode of switching rocker arm assembly 3, end pin 330-1 may be selectively extended based on selectively energizing or activating actuator 400, thereby axially and slidably displacing each roller body pin and rocker body pin (330-1, 150-1, 350, 150-2, and 330-2) toward the other end pin 330-2, such as by mutual axial engagement. In its extended position, end pin 330-1 may not interfere with a motion or any incipient motion of adjacent roller assembly 100-1, but end pin 330-1 may be capable of positioning and/or holding locking pin 150-1 axially contained in position within roller axle 125-1 and/or roller axis 130-1. Based on at least the relative lengths of the rocker body pins and roller body pins, as axially measured along latching axis 310, locking pin 150-1 may therefore be axially contained within roller assembly 100-1, thereby decoupling and deactivating roller assembly 100-1 by enabling roller assembly 100-1 to pivotally move and absorb a cam motion received by roller 105-1. Furthermore, connection pin 350 may axially displace locking pin 150-2 such that connection pin 350 may be at least partially disposed within roller axle 125-2 and/or roller axis 130-2 (coincident with latching axis 310, in this case) of roller assembly 100-2, such that connection pin 350 may interfere with or otherwise lock or operatively couple roller assembly 100-2 with respect to rocker arm body 25. Separately or additionally, locking pin 150-2 may be at least partially axially disposed within a bore corresponding to end pin 330-2, so that locking pin 150-2 may separately or additionally provide locking or operative coupling support for locking roller assembly 100-2 with respect to rocker arm body 25. End pin 330-2, which may be provided with a pin biasing member 420 and/or actuator 400-2 (not shown), may be configured in a retracted position in this mode. By way of example and not limitation, a pin biasing member 420 corresponding to end pin 330-2 may be compressed in a first latching mode, as described. By way of example and not limitation, a pin biasing member 420-1, if provided corresponding to end pin 330-1, may be expanded or relaxed in such a second latching mode. By way of example and not limitation, an actuator 400-2, if provided corresponding to end pin 330-2, may be de-energized or deactivated in such a first latching mode.

By way of example and not limitation, with reference to FIGS. 3B, 3D, and 5 illustrating a second latching mode of switching rocker arm assembly 3 relative to the first latching mode illustrated in FIGS. 3A, 3C, and 4 respectively, end pin 330-1 may be selectively retracted and/or end pin 330-2 may be selectively extended. By way of example and not limitation, such selective retraction and/or extension may be enabled based on selectively de-energizing or deactivating actuator 400 of end pin 330-1, such as against a biasing force from pin biasing member 420 acting at the opposite end pin 330-2, and/or by energizing an actuator 400-2 at end pin 330-2, so as to cause axial and slidable displacement of each roller body pin and rocker body pin (330-1, 150-1, 350, 150-2, and 330-2) toward the end pin 330-1, such as by mutual axial engagement. In its extended position, end pin 330-2 may not interfere with a motion or any incipient motion of adjacent roller assembly 100-2, but end pin 330-2 may be capable of positioning and/or holding locking pin 150-2 axially contained within roller axle 125-2 and/or roller axis 130-2. Based on at least the relative lengths of the rocker body pins and roller body pins, as axially measured along latching axis 310, locking pin 150-2 may therefore be axially contained within roller assembly 100-2, thereby decoupling and deactivating roller assembly 100-2 by enabling roller assembly 100-2 to pivotally move and absorb a cam motion received by roller 105-2. Furthermore, connection pin 350 may axially displace locking pin 150-1 such that connection pin 350 may be at least partially disposed within roller axle 125-1 and/or roller axis 130-1 (coincident with latching axis 310, in this case) of roller assembly 100-1, such that connection pin 350 may interfere with or otherwise lock or operatively couple roller assembly 100-1 with respect to rocker arm body 25. Separately or additionally, locking pin 150-1 may be at least partially axially disposed within a bore corresponding to end pin 330-1, which may separately or additionally provide locking or operative coupling support for locking roller assembly 100-1 with respect to rocker arm body 25. End pin 330-1, which may be provided with a pin biasing member 420-1 (not shown) and/or actuator 400, may be found in a retracted position in this mode. By way of example and not limitation, a pin biasing member 420 corresponding to end pin 330-2 may be expanded or relaxed in such a second latching mode. By way of example and not limitation, a pin biasing member 420-1, if provided corresponding to end pin 330-1, may be compressed in such a second latching mode. By way of example and not limitation, an actuator 400, if provided corresponding to end pin 330-1, may be de-energized or deactivated in such a second latching mode.

In the case of a decoupled roller assembly in any situation or mode, a respective roller axis 130-1 or 130-2 corresponding to a respective roller body pin, such as a locking pin 150-1 or 150-2, may be positioned such that the respective roller axis 130-1 or 130-2 is at least momentarily and/or periodically aligned with the latching axis 310 as the decoupled roller assembly moves relative to rocker arm body 25.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

Numerical ranges recited in this application should be construed to be inclusive of the end points of the stated ranges. Particular axes, such as one or more lateral and/or longitudinal axes, which may be omitted herein in some illustrations, should be construed to exist in every illustration or situation where it is referred to.

The invention claimed is:

1. A rocker arm assembly comprising:

a rocker arm body;

a first roller assembly pivotally connected to the rocker arm body, the first roller assembly including a first roller configured to rotate about a first roller axis and to engage a first cam;

a second roller assembly pivotally connected to the rocker arm body, the second roller assembly including a second roller configured to rotate about a second roller axis and to engage a second cam; and a latching mechanism configured to selectively decouple one of the first roller assembly or the second roller assembly from the rocker arm body, the latching mechanism comprising:

rocker body pins comprising a first end pin, a second end pin, and a connection pin disposed between the first and second end pins, each of the rocker body pins slidably disposed at least partially within the rocker arm body along a latching axis; and roller body pins comprising a first locking pin and a second locking pin, the first locking pin disposed between the first end pin and the connection pin, the second locking pin disposed between the connection pin and the second end pin, the first locking pin slidably disposed at least partially within the first roller assembly along the first roller axis, and the second locking pin slidably disposed at least partially within the second roller assembly along the second roller axis, wherein, when a first latching mode is enabled such that the first roller assembly is deactivated and the second roller assembly is activated, the rocker body pins and the roller body pins are slidably displaced toward the second end pin, and wherein, when a second latching mode is enabled such that the second roller assembly is deactivated and the first roller assembly is activated, the rocker body pins and the roller body pins are slidably displaced toward the first end pin.

2. The rocker arm assembly of claim 1, wherein, when the first latching mode is enabled, the first end pin is axially extended toward the first roller assembly such that (i) the first locking pin is axially contained within the first roller assembly so as to enable the first roller assembly to pivotally absorb a first cam motion of the first cam, and (ii) the connection pin is at least partially disposed within the roller axis of the second roller assembly, thereby coupling the second roller assembly to the rocker arm body so as to transmit a second cam motion of the second cam to the rocker arm body.

3. The rocker arm assembly of claim 1, wherein, when the second latching mode is enabled, the second end pin is axially extended toward the second roller assembly such that (i) the second locking pin is axially contained within the second roller assembly so as to enable the second roller assembly to pivotally absorb a second cam motion of the second cam, and (ii) the connection pin is at least partially disposed within the roller axis of the first roller assembly, thereby coupling the first roller assembly to the rocker arm body so as to transmit a first cam motion of the first cam to the rocker arm body.

4. The rocker arm assembly of claim 1, wherein the first and second roller assemblies are respectively biased by first and second roller biasing members toward respective first and second end positions, and wherein the roller body pins and the latching axis of the rocker body pins are coaxial when the first and second roller assemblies are respectively positioned in the first and second end positions.

5. The rocker arm assembly of claim 1, wherein the first and second roller assemblies are biased by a biasing member toward respective first and second end positions, and the roller body pins and the latching axis of the rocker body pins are coaxial when the first and second roller assemblies are respectively positioned in the first and second end positions.

6. The rocker arm assembly of claim 1, wherein the connection pin has a length, measured along the latching axis, that is greater than a shortest distance between the first and second roller assemblies measured along the latching axis.

7. The rocker arm assembly of claim 1, wherein a first axial length of the first locking pin is configured to enable the first locking pin to be selectively contained within the first roller assembly, and a second axial length of the second locking pin is configured to enable the second locking pin to be selectively contained within the second roller assembly.

8. The rocker arm assembly of claim 1, wherein the first end pin is biased toward the second end pin by a pin biasing member.

9. The rocker arm assembly of claim 1, wherein the rocker arm body is configured to selectively rotate about a rocker shaft located between a valve end of the rocker arm body and a cam end of the rocker arm body.

10. The rocker arm assembly of claim 1, wherein one or both of the first end pin and the second end pin are configured to be selectively extendable based on a force applied by an actuator system.

11. The rocker arm assembly of claim 10, wherein the actuator system comprises a hydraulic actuator.

12. The rocker arm assembly of claim 10, wherein the actuator system comprises a solenoid.

13. A method of operating the rocker assembly of claim 1 to enable the first latching mode, the method comprising:

axially translating the first end pin toward the first roller assembly to displace the first locking pin, the connection pin, and the second locking pin;

deactivating the first roller assembly so as to enable the first roller assembly to pivotally absorb a first cam motion of the first cam when the first locking pin is contained within the first roller assembly; and activating the second roller assembly such that the second roller assembly is operatively coupled to the rocker arm body so as to transmit a second cam motion of the second cam to the rocker arm body when the connection pin and the second locking pin are partially disposed within the second roller assembly.

14. The method of claim 13, further comprising, enabling the second latching mode by:

axially translating the second end pin toward the second roller assembly to displace the second locking pin, the connection pin, and the first locking pin;

deactivating the second roller assembly so as to enable the second roller assembly to pivotally absorb the second cam motion when the second locking pin is contained within the second roller assembly; and activating the first roller assembly such that the first roller assembly is operatively coupled to the rocker arm body so as to transmit the first cam motion to the rocker arm body when the connection pin and the first locking pin are partially disposed within the first roller assembly.

15. The method of claim 13, further comprising:

biasing (i) the first roller assembly by a first roller biasing member toward a first end position and (ii) the second roller assembly by a second roller biasing member toward a second end position, wherein the first locking pin and the second locking pin are coaxially located with the latching axis when the first and second roller assemblies are respectively positioned in the first and second end positions.

16. The method of claim 13, further comprising:

biasing, using a roller biasing member, the first roller assembly and the second roller assembly toward a first end position and a second end position, respectively, wherein the first locking pin and the second locking pin are coaxially located with the latching axis when the first and second roller assemblies are respectively positioned in the first and second end positions.

17. The method of claim 13, further comprising:

biasing the first end pin toward the second end pin by a pin biasing member.

18. An engine valvetrain system comprising:

a camshaft comprising a plurality of cams;

a plurality of valves;

a rocker arm assembly configured to rotate about a rocker shaft, the rocker arm assembly comprising:

a rocker arm body;

a first roller assembly pivotably connected to the rocker arm body, the first roller assembly including a first roller configured to rotate about a first roller axis and to engage a first cam of the plurality of cams;

a second roller assembly pivotally connected to the rocker arm body, the second roller assembly including a second roller configured to rotate about a second roller axis and to engage a second cam; and a latching mechanism configured to selectively decouple one of the first roller assembly or the second roller assembly from the rocker arm body, the latching mechanism comprising:

rocker body pins comprising a first end pin, a second end pin, and a connection pin disposed between the first and second end pins, each of the rocker body pins slidably disposed at least partially within the rocker arm body along a latching axis; and roller body pins comprising a first locking pin and a second locking pin, the first locking pin disposed between the first end pin and the connection pin, the second locking pin disposed between the connection pin and the second end pin, the first locking pin slidably disposed at least partially within the first roller assembly along the first roller axis, and the second locking pin slidably disposed at least partially within the second roller assembly along the second roller axis, wherein, when a first latching mode is enabled such that the first roller assembly is deactivated and the second roller assembly is activated, the rocker body pins and the roller body pins are slidably displaced toward the second end pin, and wherein, when a second latching mode is enabled such that the second roller assembly is deactivated and the first roller assembly is activated, the rocker body pins and the roller body pins are slidably displaced toward the first end pin.

19. The engine valvetrain system of claim 18, wherein the first and second roller assemblies are respectively biased by first and second roller biasing members toward respective first and second end positions, and wherein the roller body pins and the latching axis of the rocker body pins are coaxial when the first and second roller assemblies are respectively positioned in the first and second end positions.

20. The engine valvetrain system of claim 18, wherein the first and second roller assemblies are biased by a biasing member toward respective first and second end positions, and the roller body pins and the latching axis of the rocker body pins are coaxial when the first and second roller assemblies are respectively positioned in the first and second end positions.

* * * * *